US012529497B2

(12) United States Patent
Aly et al.

(10) Patent No.: US 12,529,497 B2
(45) Date of Patent: Jan. 20, 2026

(54) MULTI-CONFIGURATION DRAIN PAN ASSEMBLY

(71) Applicant: Johnson Controls Tyco IP Holdings LLP, Milwaukee, WI (US)

(72) Inventors: Amr Maher Aly, Wichita, KS (US); Xianjin Cheng, Andover, KS (US); Elmer Wayne Romero, Oxford, KS (US); D'Marcus Letrey Garrett, Wichita, KS (US)

(73) Assignee: Johnson Controls Light Commercial IP GmbH, Shaffahausen (CH)

( * ) Notice: Subject to any disclaimer, the term of this patent is extended or adjusted under 35 U.S.C. 154(b) by 401 days.

(21) Appl. No.: 18/337,271

(22) Filed: Jun. 19, 2023

(65) Prior Publication Data

US 2024/0418401 A1 Dec. 19, 2024

(51) Int. Cl.

| | |
|---|---|
| ***F24F 13/22*** | (2006.01) |
| ***F24F 13/20*** | (2006.01) |
| *F25D 21/14* | (2006.01) |

(52) U.S. Cl.

CPC ..... *F24F 13/222* (2013.01); *F24F 13/20* (2013.01); *F25D 21/14* (2013.01); *F25D 2321/145* (2013.01)

(58) Field of Classification Search

CPC ..... F24F 13/22; F24F 13/222; F24F 13/20; F25D 21/14; F25D 2321/145

See application file for complete search history.

(56) References Cited

U.S. PATENT DOCUMENTS

| | | | | |
|---|---|---|---|---|
| 4,474,232 | A * | 10/1984 | Wright | F24F 13/22 165/137 |
| 5,987,909 | A * | 11/1999 | Martin, Sr. | F24F 13/222 62/291 |
| D761,943 | S | 7/2016 | Yamamoto et al. | |
| 10,126,013 | B2 | 11/2018 | Yamamoto | |
| 2005/0109053 | A1* | 5/2005 | Eom | F24F 13/222 62/286 |
| 2021/0372659 | A1* | 12/2021 | Bauer | F24F 13/30 |

* cited by examiner

*Primary Examiner* — Joseph F Trpisovsky
(74) *Attorney, Agent, or Firm* — Kelly McGlashen

(57) ABSTRACT

An HVAC system may include a housing having a first wall and a second wall opposite the first wall and an evaporator disposed within a portion of the housing to cool an air flow. The portion of the housing may include an inlet and an outlet to receive and output the air flow. The HVAC system may also include a multi-configuration drain pan assembly that collects condensate formed by cooling of the air flow and may include a first drain pan and a second drain pan. The first drain pan may selectively couple to the housing in a first position or a second position, and, the second drain pan may couple to the housing in a third position or a fourth position, different from the third position, relative to the first drain pan.

20 Claims, 9 Drawing Sheets

MULTI-CONFIGURATION DRAIN PAN ASSEMBLY

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Environmental control systems are utilized in residential, commercial, and industrial environments to control environmental properties, such as temperature and humidity, for occupants of the respective environments. The environmental control system may control the environmental properties through control of an air flow delivered to the environment. In some cases, environmental control systems include a vapor compression system, which includes heat exchangers, such as a condenser and an evaporator, that transfer thermal energy between the vapor compression system and the environment. Fans or blowers may direct a flow of supply air across a heat exchange area of the evaporator, and refrigerant circulating through the evaporator may absorb thermal energy from the supply air. Accordingly, the evaporator may discharge conditioned air, which is subsequently directed toward a cooling load, such as an interior of a building. In some instances, the evaporator may condense moisture suspended within the supply air, and condensate may form on an exterior surface of the evaporator. The condensate is generally directed to a drain pan that collects the condensate generated by the evaporator. However, in some scenarios, the air flow passing across the evaporator may displace condensate accumulated thereon and/or dripping therefrom such that the condensate lands in an undesirable or less desirable location (e.g., beyond the drain pan).

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure relates to a heating, ventilation, and/or air conditioning (HVAC) system that includes a housing and a heat exchanger, disposed within a section of the housing, that conditions an air flow through the housing. The section may include an inlet that receives the air flow and an outlet that outputs the air flow. Additionally, the HVAC system may include a multi-configuration drain pan assembly that collects condensate formed by conditioning of the air flow by the heat exchanger and includes a first drain pan and a second drain pan. The first drain pan may selectively couple to the housing in one of a first set of positions within the housing, the first set of positions including a first position and a second position. When in the first position, the first drain pan is disposed along a first wall of the housing such that a first side of the first drain pan is disposed at the inlet and a second side of the first drain pan is disposed at the outlet. When in the second position, the first drain pan is disposed along a second wall of the housing, opposite the first wall, such that the first side of the first drain pan is disposed at the outlet and the second side of the first drain pan is disposed at the inlet. Additionally, the second drain pan may selectively couple to the housing in one of a second set of positions within the housing, the second set of positions including a third position and a fourth position. When in the third position, the second drain pan is disposed about the inlet such that a third side of the second drain pan is disposed at the first side of the first drain pan. Additionally, when in the fourth position the second drain pan is disposed about the inlet such that a fourth side of the second drain pan, opposite the third side, is disposed at the second side of the first drain pan.

The present disclosure also relates to a multi-configuration drain pan assembly that includes a first drain pan and a second drain pan. The first drain pan may include a first side, a second side opposite the first side, and a first drain. Additionally, the first drain pan may, in response to the first drain pan being oriented laterally in one of a set of lateral configurations, relative to gravity, receive condensate dripped onto the first drain pan and output the condensate via the first drain. The set of lateral configurations may include a first lateral configuration and a second lateral configuration. Additionally, the second drain pan may be perpendicular to the first drain pan and include a third side, a fourth side opposite the third side, and a second drain. Moreover, the second drain pan may, in response to the first drain pan being oriented vertically, relative to gravity, in a vertical configuration, receive the condensate dripped onto the second drain pan and output the condensate via the second drain. Furthermore, the second drain pan may be disposed at the first side of the first drain pan in the first lateral configuration and disposed at the second side of the first drain pan in the second lateral configuration.

The present disclosure further relates to an HVAC system including a housing having a first wall and a second wall opposite the first wall and an evaporator disposed within a portion of the housing to cool an air flow. The portion of the housing may include an inlet and an outlet to receive and output the air flow. The HVAC system may also include a multi-configuration drain pan assembly that collects condensate formed by cooling of the air flow and may include a first drain pan and a second drain pan. The first drain pan may selectively couple to the housing in one of a first set of positions within the housing, the first set of positions including a first position and a second position. When in the first position, the first drain pan is disposed along the first wall such that a first side of the first drain pan is disposed at the inlet and a second side of the first drain pan is disposed at the outlet, and when in the second position, the first drain pan is disposed along the second wall, such that the first side of the first drain pan is disposed at the outlet and the second side of the first drain pan is disposed at the inlet. Additionally, the second drain pan may be coupled to the housing about the inlet and include a third side disposed at the first wall of the housing and a fourth side disposed at the second wall of the housing.

BRIEF DESCRIPTION OF DRAWINGS

Various aspects of this disclosure may be better understood upon reading the following detailed description and upon reference to the drawings in which.

DETAILED DESCRIPTION

Figure 1:
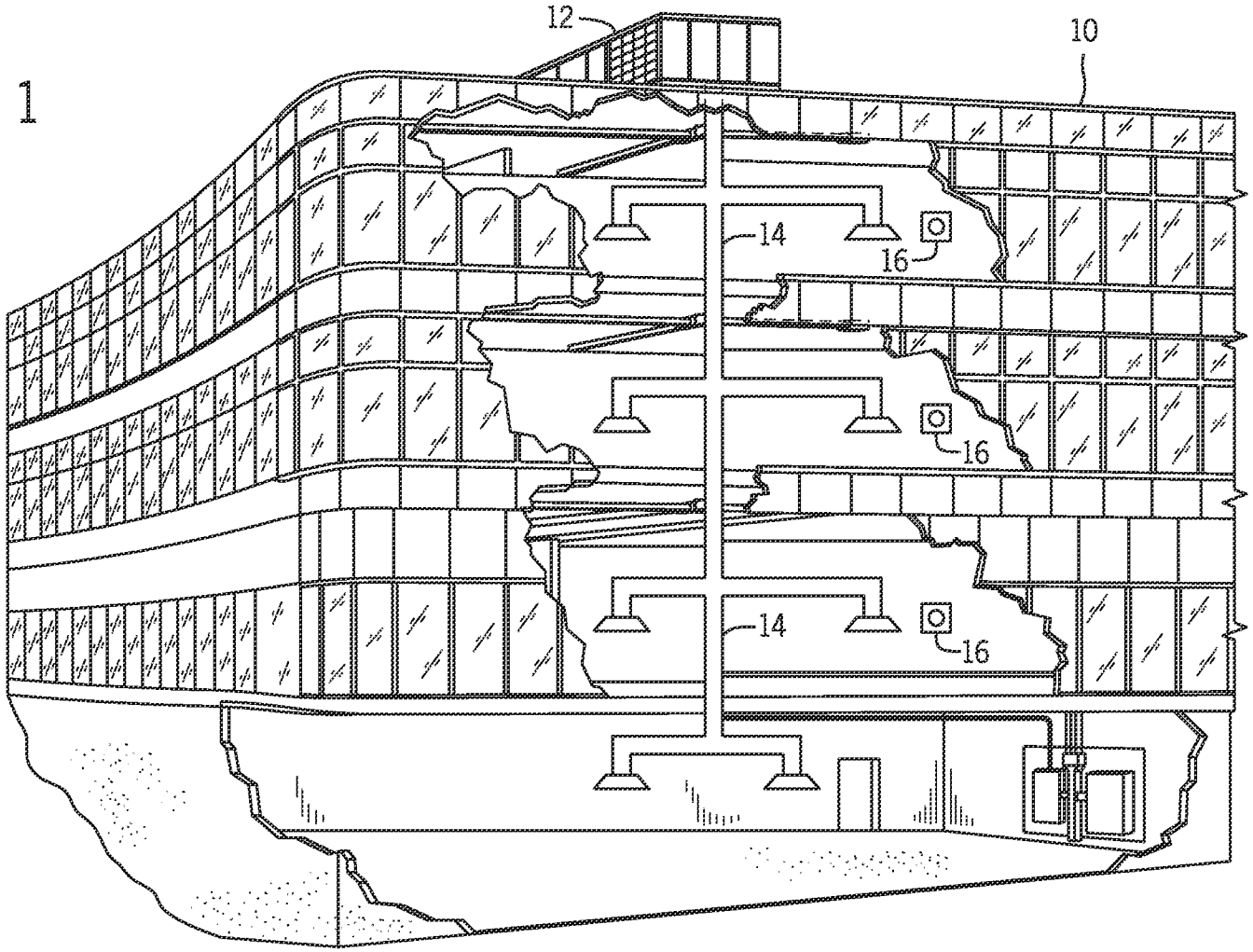
FIG. 1 is a perspective view of an embodiment of a building incorporating a heating, ventilation, and/or air conditioning (HVAC) system in a commercial setting, in accordance with an aspect of the present disclosure.

One or more specific embodiments of the present disclosure will be described below. These described embodiments are examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As used herein, the terms "approximately," "generally," and "substantially," and so forth, are intended to convey that the property value being described may be within a relatively small range of the property value, as those of ordinary skill would understand. For example, when a property value is described as being "approximately" equal to (or, for example, "substantially similar" to) a given value, this is intended to mean that the property value may be within +/−5%, within +/−4%, within +/−3%, within +/−2%, within +/−1%, of the given value or even closer. Similarly, when a given feature is described as being "substantially parallel" to another feature, "generally perpendicular" to another feature, and so forth, this is intended to mean that the given feature is within +/−5%, within +/−4%, within +/−3%, within +/−2%, within +/−1%, or even closer, to having the described nature, such as being parallel to another feature, being perpendicular to another feature, and so forth. Further, it should be understood that mathematical terms, such as "planar." "slope," "perpendicular," "parallel," and so forth are intended to encompass features of surfaces or elements as understood to one of ordinary skill in the relevant art, and should not be rigidly interpreted as might be understood in the mathematical arts. For example, a "planar" surface is intended to encompass a surface that is machined, molded, or otherwise formed to be substantially flat or smooth (within related tolerances) using techniques and tools available to one of ordinary skill in the art. Similarly, a surface having a "slope" is intended to encompass a surface that is machined, molded, or otherwise formed to be oriented at an angle (e.g., incline) with respect to a point of reference using techniques and tools available to one of ordinary skill in the art.

As briefly discussed above, a heating, ventilation, and/or air conditioning (HVAC) system may be used to thermally regulate a space within a building, home, or other suitable structure. For example, the HVAC system may include a vapor compression system that transfers thermal energy between a working fluid, such as a refrigerant, and a fluid to be conditioned, such as air. The vapor compression system includes heat exchangers (e.g. a condenser, an evaporator) that are fluidly coupled to one another via one or more conduits to form a refrigerant circuit. A compressor may be used to circulate the refrigerant through the refrigerant circuit and enable the transfer of thermal energy between components of the vapor compression system (e.g., the condenser, the evaporator) and one or more thermal loads (e.g., an environmental air flow, a supply air flow).

In general, one or more heat exchangers of the HVAC system may operate to condition a flow of air that is supplied to a conditioned space, such as the interior of a building. The air to be conditioned may include ambient (e.g., outside) air, return air, a mixture of ambient air and return air, and/or another suitable flow of air. The HVAC system may include one or more fans or blowers that direct a flow of air across a heat exchange area of a heat exchanger to enable conditioning (e.g., heating, cooling, dehumidification) of the air. For example, the refrigerant within an evaporator may absorb thermal energy from the air flow, thereby cooling the air flow before the air flow is discharged toward a conditioned space as a supply air flow.

Cooling of the air flow via the evaporator may cause moisture suspended within the air flow to condense, thereby forming condensate. In certain instances, condensate generated via the evaporator may initially collect on the heat exchange area of the evaporator. Condensate formed and/or accumulated on the evaporator may fall (e.g., via force of gravity or assisted by the air flow) toward a drain pan positioned vertically beneath the evaporator. The drain pan may collect the condensate that falls from the evaporator and direct the condensate toward a drain or other suitable discharge outlet. For example, in some cases an HVAC system or HVAC unit having an evaporator may be arranged to direct an air flow across the evaporator in a generally lateral direction, such as either left to right or right to left with respect to a side of the housing. Additionally, vertical orientations of the HVAC system may cause the air flow to travel across the evaporator with an upward or downward flow. Gravity and/or the air flow may cause the condensate to fall into a drain pan for collection and discharge.

However, in some scenarios, the evaporator may be arranged (e.g., positioned, oriented) in a manner that reduces the effectiveness of conventional drain pans. For example, the air flow may cause condensate formed and/or accumulated on the evaporator to be displaced or carried in the direction (e.g., lateral direction) of the air flow such that the condensate lands elsewhere from the drain pan, a phenomenon referred to as blowoff. Moreover, increased turbulence and/or velocity of the air flow may increase blowoff by causing the condensate to travel further, increasing the possibility of missing the drain pan. Traditionally, the setup orientation of the HVAC system (e.g., defining the direction of flow through the HVAC system relative to the evaporator and/or housing) may cause increased blowoff due, at least in part, to the location and/or orientation of the evaporator relative to the drain pan.

However, in some embodiments of the present disclosure, an improved condensate collection system may include a multi-configuration drain pan assembly that maintains improved capture of condensate formed during operation of an HVAC system in multiple different orientations (e.g., left to right and right to left flow orientations). For example, the multi-configuration drain pan assembly may include a longitudinal drain pan that collects condensate when the HVAC system is in a lateral flow (e.g., left to right or right to left) orientation and a perpendicular drain pan that collects condensate when the HVAC system is in a vertical flow (e.g., up to down or down to up) orientation. Moreover, the same longitudinal drain pan and perpendicular drain pan may be utilized for each of the orientations and allow for multiple different orientations of the evaporator relative to the air flow. For example, in lateral flow orientations, the evaporator may be disposed with an apex downstream of the air flow, meaning that the orientation of the evaporator may be flipped, relative to the housing, depending on the direction of the air flow. Moreover, the multi-configuration drain pan assembly allows for reorganization of the same longitudinal drain pan and perpendicular drain pan, relative to the housing, such that the relative orientation of the multi-configuration drain pan assembly and the evaporator is the same for each lateral flow orientation. As such, blowoff may be reduced or eliminated and may be generally the same in either of the lateral flow orientations.

In this way, an improved condensate collection system having a multi-configuration drain pan assembly may assist in reducing the likelihood of condensate permeating areas or regions external to the drain pan and/or HVAC unit. Additional details and benefits enabled by the present embodiments are described in further detail below.

Turning now to the drawings, FIG. 1 illustrates an embodiment of a heating, ventilation, and/or air conditioning (HVAC) system for environmental management that employs one or more HVAC units in accordance with the present disclosure. As used herein, an HVAC system includes any number of components that enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor to detect a climate characteristic or operating parameter, a filter, a control device to regulate operation of an HVAC system component, a component to enable regulation of climate characteristics, or a combination thereof. An "HVAC system" is a system that provides functions such as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12 with a reheat system in accordance with present embodiments. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit that operates in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
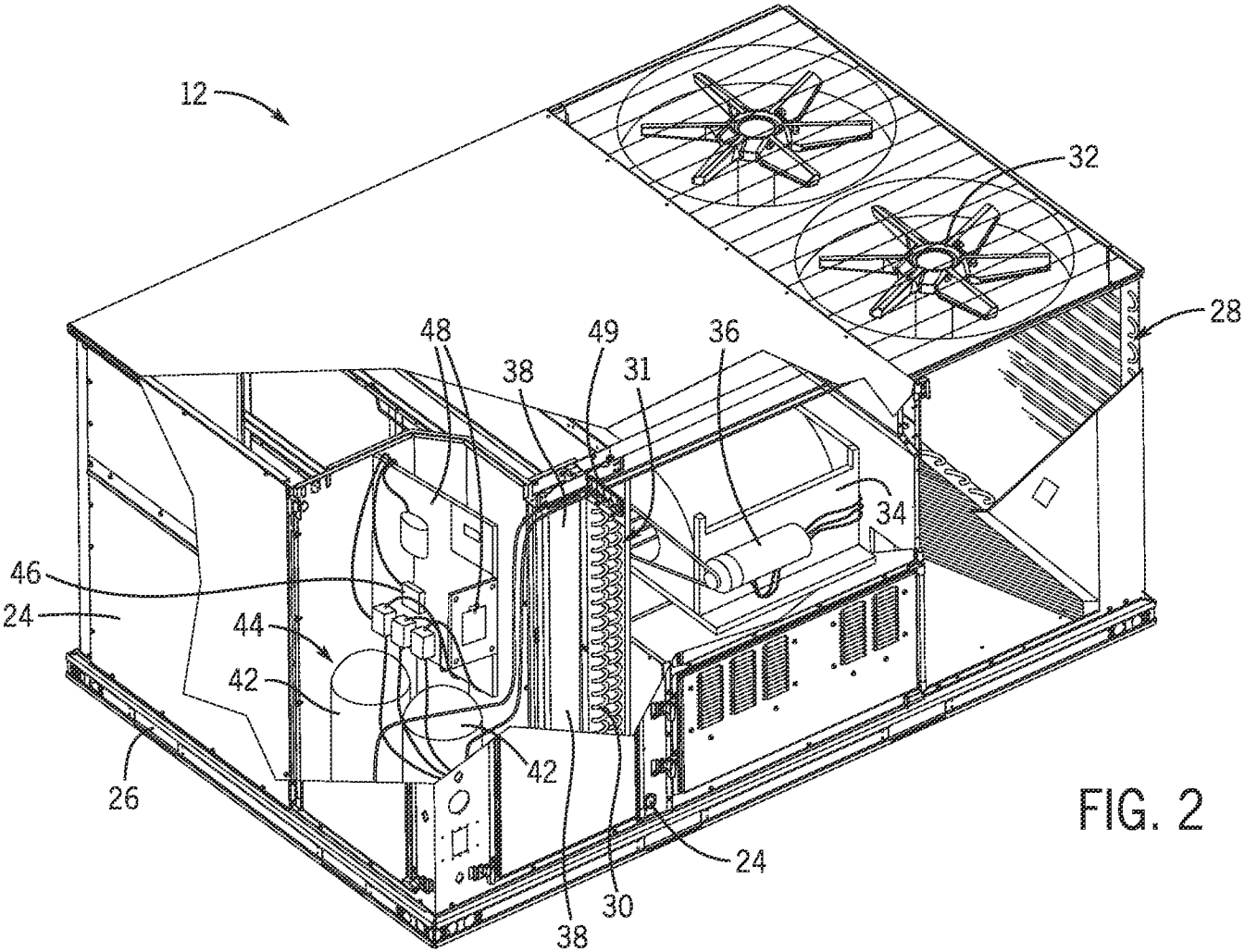
FIG. 2 is a perspective view of an embodiment of a packaged HVAC unit, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may control operation of the equipment, provide alarms, and monitor safety switches. Wiring 49 may connect the control board 48 and the terminal block 46 to the equipment of the HVAC unit 12.

Figure 3:
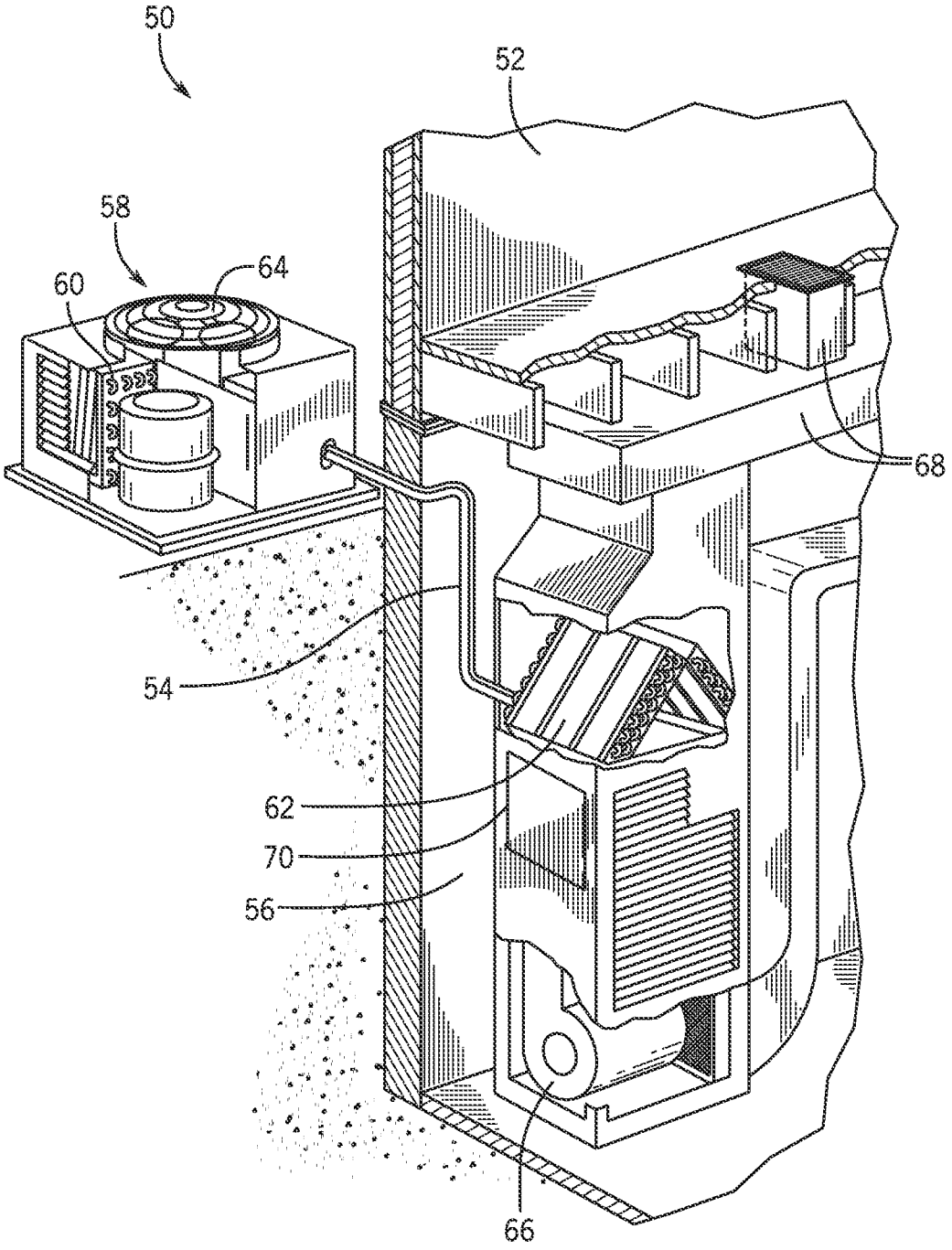
FIG. 3 is a perspective view of an embodiment of a split, residential HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower 66 or fan that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily. The outdoor unit 58 includes a reheat system in accordance with present embodiments.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the outdoor heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 to supplement or supplant a heat pump mode of the residential heating and cooling system 50. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
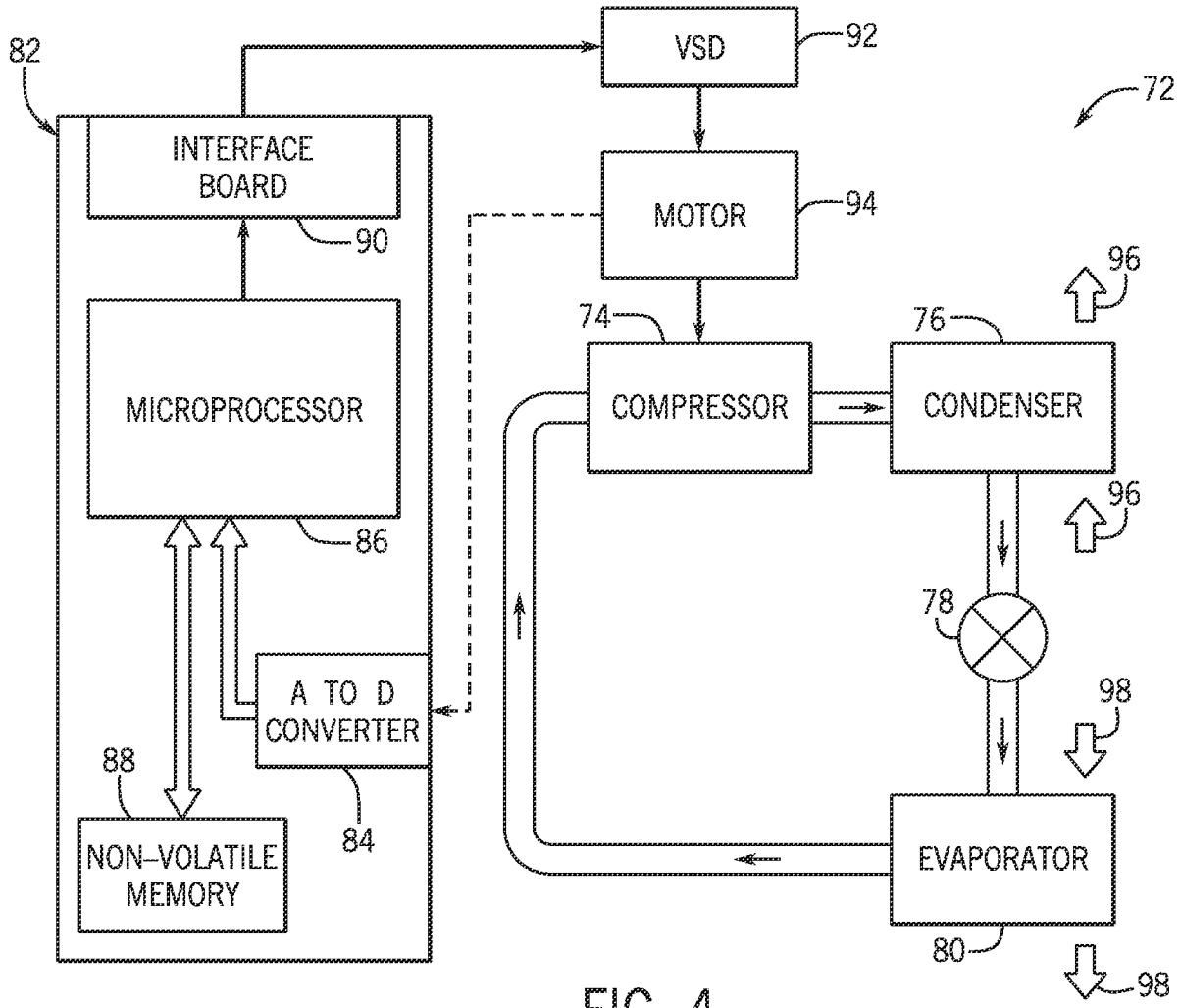
FIG. 4 is a schematic diagram of an embodiment of a vapor compression system used in an HVAC system, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil. In the illustrated embodiment, the reheat coil is represented as part of the evaporator 80. The reheat coil is positioned downstream of the evaporator heat exchanger relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

As noted above, HVAC systems typically include a drain pan to collect condensate that may form during operation of the HVAC system. However, traditional drain pans may not accommodate different installation orientations (e.g., different lateral flow orientations) in the same way leading to variable condensate collection effectiveness depending on the installation orientation. In other words, conventional drain pans may not adequately capture condensate generated during operation of the HVAC system for different installation orientations. For example, one orientation may produce more blowoff than another, and/or a different drain pan assembly may be used for different orientations. Accordingly, embodiments of the present disclosure include a multi-configuration drain pan assembly having perpendicular drain pan and a longitudinal drain pan configurable in multiple orientations relative to a housing to more efficiently capture condensate generated during HVAC system operation regardless of installation orientation.

Figure 5:
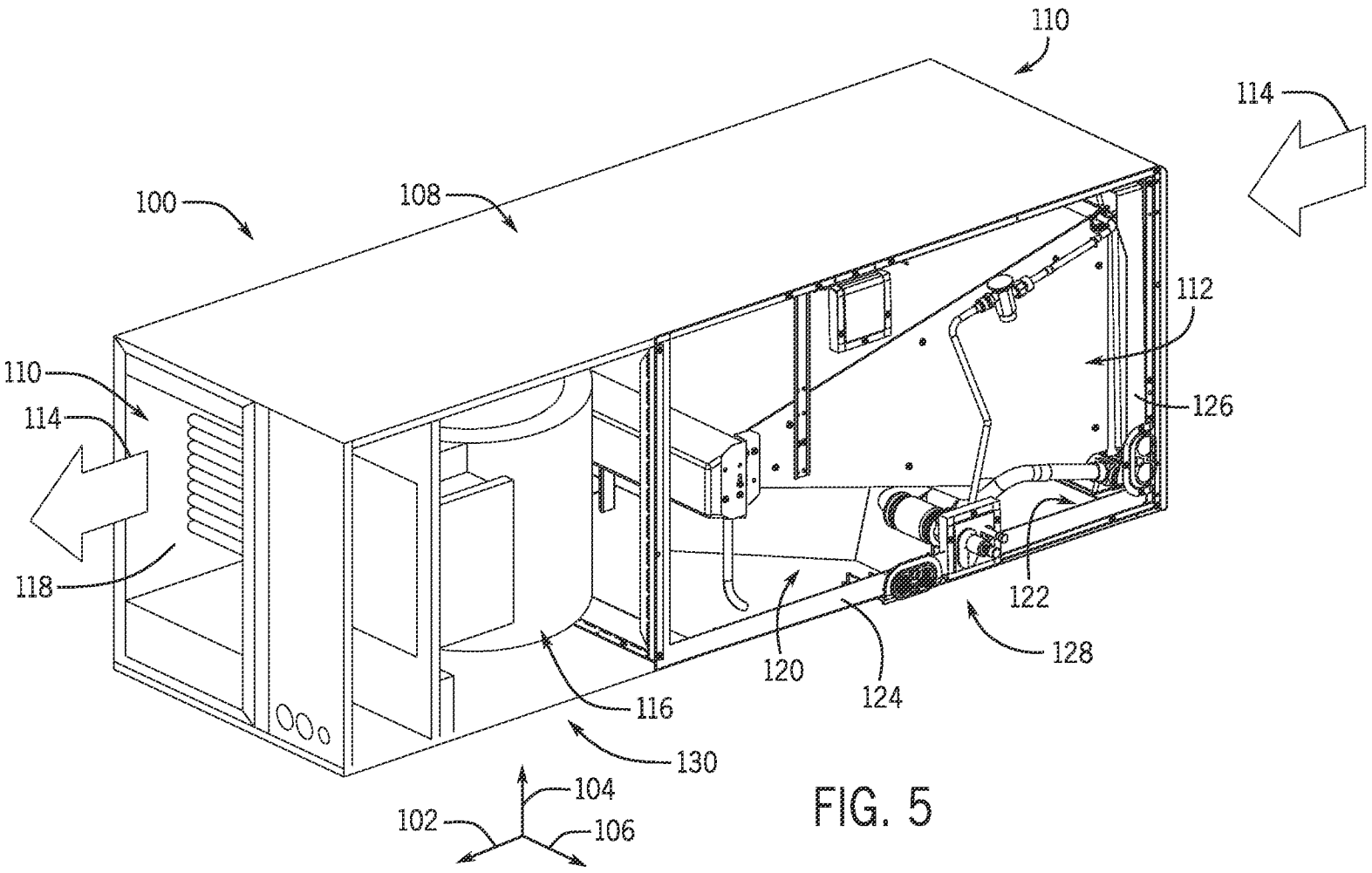
FIG. 5 is a perspective view of an embodiment of an HVAC unit including a condensate collection system having a multi-configuration drain pan assembly in a left lateral flow configuration, in accordance with an aspect of the present disclosure.

With the foregoing in mind, FIG. 5 is a perspective view of an embodiment of an HVAC unit 100 that can be used in any suitable HVAC system, such as the HVAC unit 12 of FIG. 1, the split, residential HVAC system 50 of FIG. 3, and/or the vapor compression system 72 of FIG. 4. Indeed, it should be noted that the HVAC unit 100 may include embodiments and/or components of the HVAC unit 12, embodiments or components of the split, residential HVAC system 50, a rooftop unit (RTU), an air handler or air handling unit, an outdoor unit, and indoor unit, or any other suitable HVAC system. To facilitate discussion, the HVAC unit 100 and its respective components may be described with reference to a lateral axis 102, a vertical axis 104, which is oriented relative to a direction of gravity (e.g., with the force of gravity being in the negative direction along the vertical axis 104), and a transverse axis 106.

In the illustrated embodiment, the HVAC unit 100 includes a housing 108 (e.g., enclosure) defining an air flow path 110 therethrough. A heat exchanger 112 is disposed within the housing 108 and along the air flow path 110. In general, the HVAC unit 100 directs an air flow 114 (e.g., supply air stream 98) through the housing 108 and across the heat exchanger 112 to enable conditioning of the air flow 114. For example, the heat exchanger 112 may be an evaporator or other cooling coil that cools the air flow 114 directed through the housing 108. Moreover, the air flow 114 may any suitable air flow such as a pre-conditioned air flow, a return air flow, an ambient air flow, or any combination thereof. In some embodiments, the HVAC unit 100 includes a blower 116 disposed within the housing 108 that motivates the air flow 114 along the air flow path 110, across the heat exchanger 112, to be discharged from the housing 108. For example, the air flow 114 may be discharged from the HVAC unit 100 and directed toward a conditioned space, such as via ductwork 14, 68 fluidly coupled to the air flow path 110. Additionally, in some instances, the housing 108 may also include an additional heat exchanger 118 disposed within the air flow path 110, such as a heating coil. In certain operating modes of the HVAC unit 100, the heat exchanger 112 (e.g., evaporator, cooling coil) and additional heat exchanger 118 (e.g., heating coil) may operate in conjunction with one another to dehumidify the air flow 114.

During cooling and/or dehumidification of the air flow 114, moisture within the air flow 114 may condense in the form of liquid droplets, which may collect on the heat exchanger 112 and/or drip therefrom. As should be appreciated, collection and disposal of the condensate may keep the condensate from flowing to unintended areas or region within the housing 108 (e.g., the blower 116, filters (e.g., filter 38), etc.) and/or external to the housing 108 (e.g., ductwork 14, 68, building 10, residence 52, etc.). As such, in some embodiments, the HVAC unit 100 includes a condensate collection system 120 including a multi-configuration drain pan assembly 122. For example, the multi-configuration drain pan assembly 122 may include a longitudinal drain pan 124 (e.g., generally disposed in a plane parallel with the air flow 114) and a perpendicular drain pan 126 (e.g., generally disposed in a plane perpendicular to the air flow 114) to collect condensate that may fall from the heat exchanger 112 or other portions of the housing 108 due to force of gravity (e.g., along vertical axis 104) and/or the air flow 114 (e.g., at least partially along lateral axis 102), such as blowoff.

Furthermore, as discussed herein, the HVAC unit 100 may be installed in different orientations to facilitate different directions of the air flow 114 relative to the lateral axis 102 and vertical axis 104. For example, in the illustrated embodiment of FIG. 5, the housing 108 and the heat exchanger 112 are arranged in a left lateral flow configuration (e.g., flowing from right to left in the positive direction along the lateral axis 102). Furthermore, FIG. 6 is a perspective view of an embodiment of the HVAC unit 100 in a right lateral flow configuration (e.g., flowing from left to right in the negative direction along the lateral axis 102).

Figure 6:
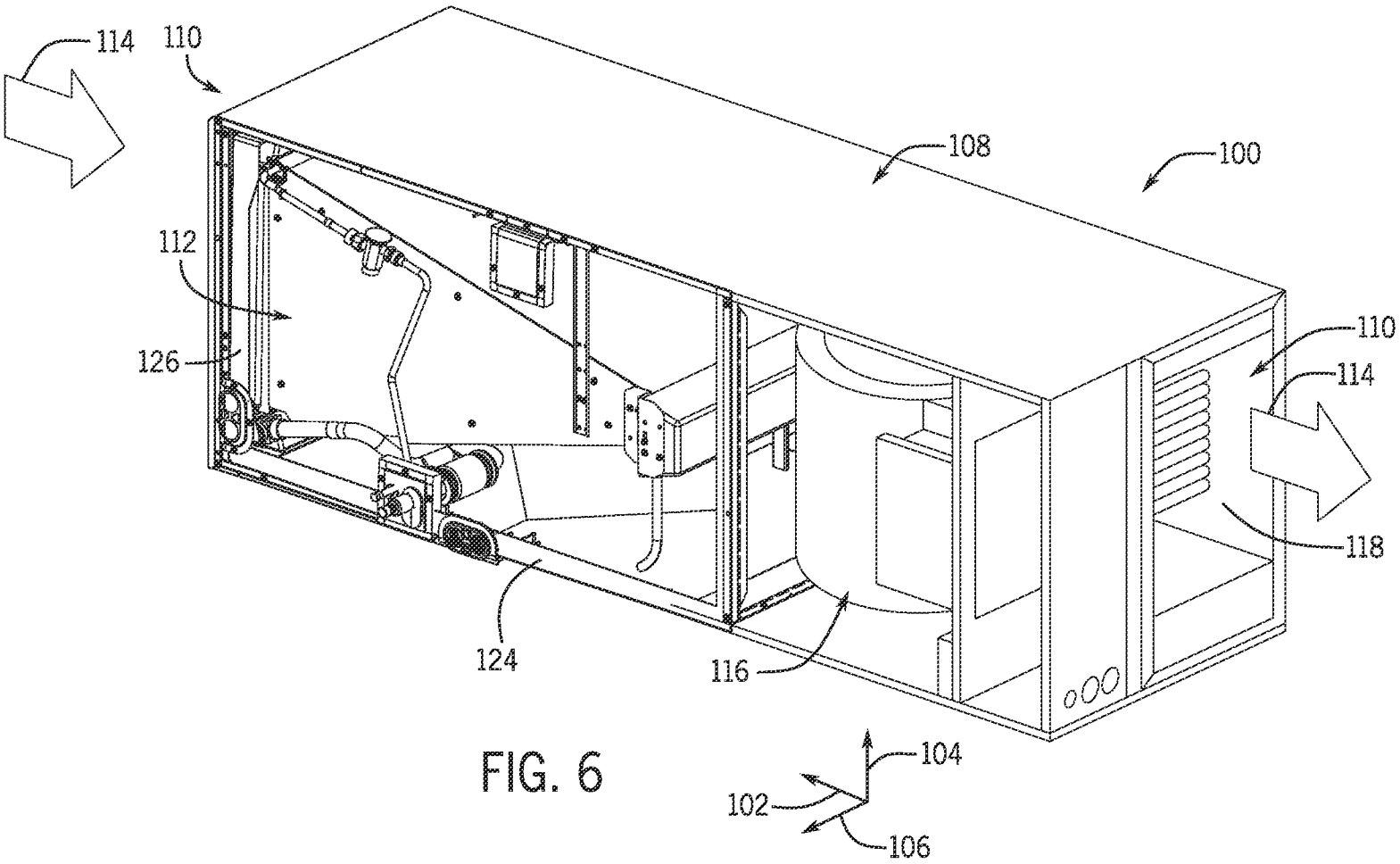
FIG. 6 is a perspective view of an embodiment of an HVAC unit including a condensate collection system having a multi-configuration drain pan assembly in a right lateral flow configuration, in accordance with an aspect of the present disclosure.

With reference to FIGS. 5 and 6, the HVAC unit 100 may include a first conditioning section 128, such as including the heat exchanger 112 and at least a portion of the condensate collection system 120 (e.g., the multi-configuration drain pan assembly 122), and a second conditioning section 130, such as including the blower 116, one or more filters 38, and/or an additional heat exchanger 118. As should be appreciated, to position the HVAC unit 100 in the different lateral configurations, while maintaining the same relative positions of the first conditioning section 128 and second conditioning section 130 with respect to the air flow path 110, the housing 108 of the HVAC unit 100 may be inverted with respect to the vertical axis 104. In other words, the housing 108 of the HVAC unit 100 may be flipped over (with respect to the vertical axis 104) in the right lateral flow configuration (as in FIG. 6) when compared to the left lateral flow configuration (as in FIG. 5). As discussed further below, the multi-configuration drain pan assembly 122 may utilize the same longitudinal drain pan 124 and perpendicular drain pan 126 in the different lateral flow configurations (e.g., left lateral flow configuration and right lateral flow configuration).

Figure 7:
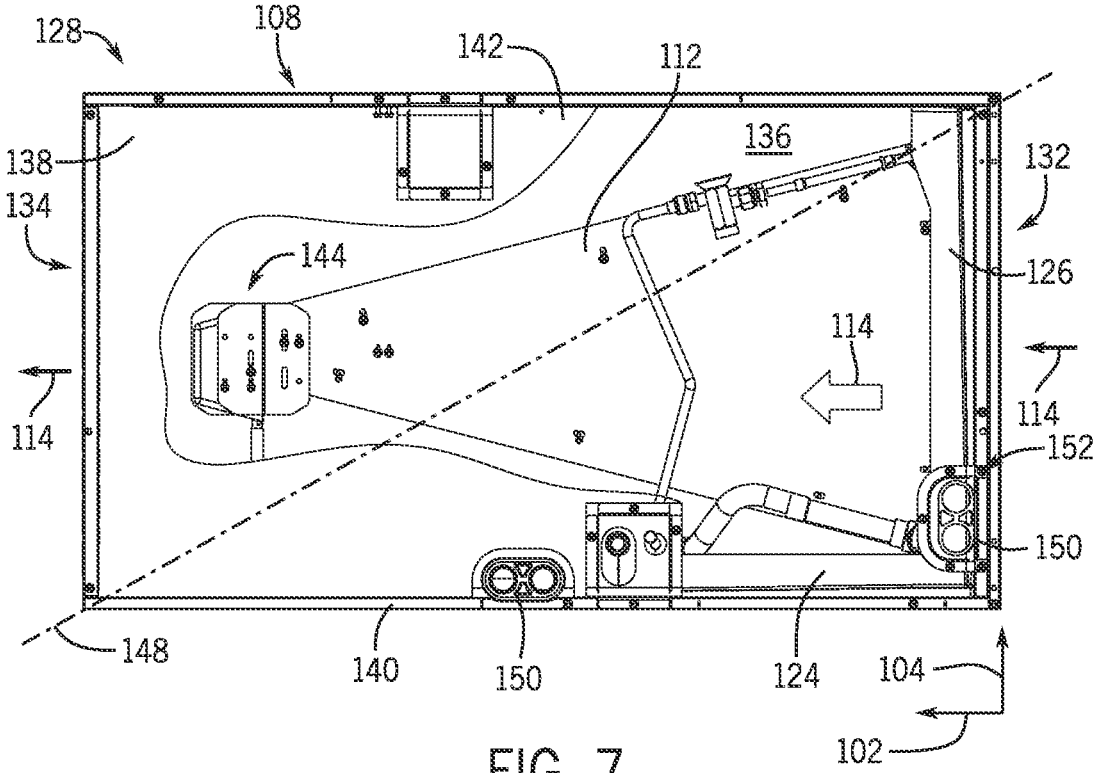
FIG. 7 is a side view of a conditioning section of the HVAC unit with a multi-configuration drain pan assembly in a left lateral flow configuration, in accordance with an aspect of the present disclosure.
Figure 8:
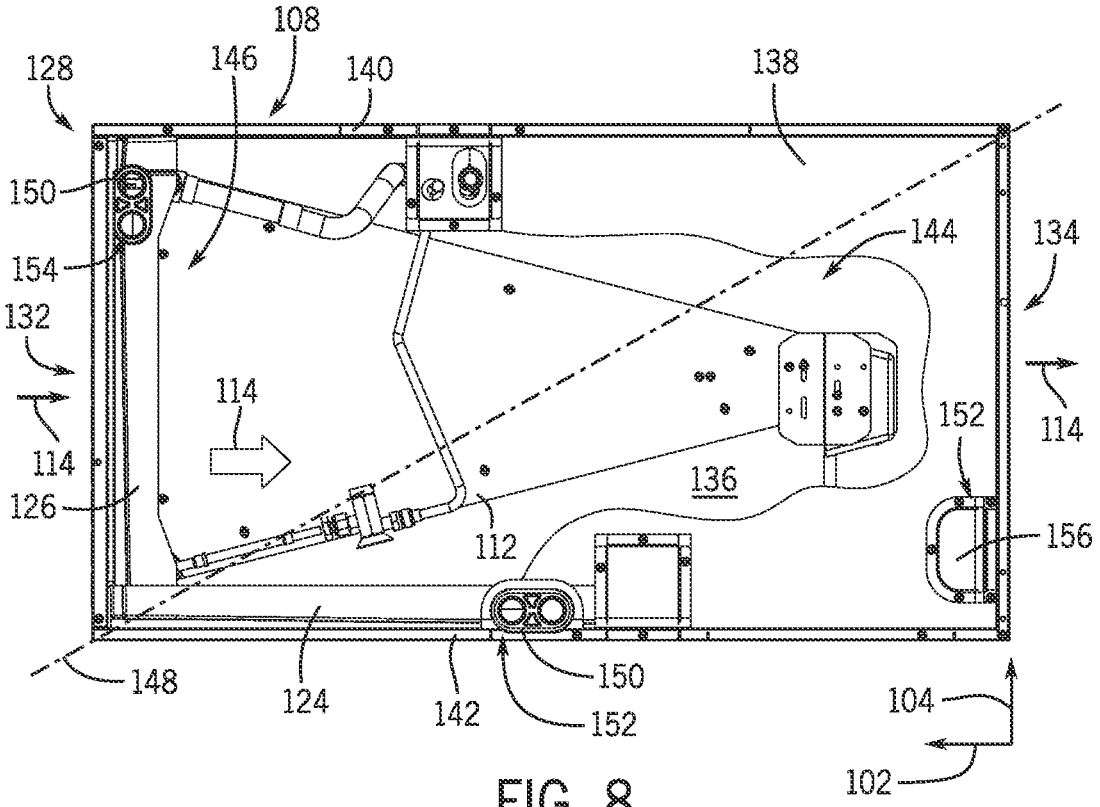
FIG. 8 is a side view of a conditioning section of the HVAC unit with a multi-configuration drain pan assembly in a right lateral flow configuration, in accordance with an aspect of the present disclosure.

FIGS. 7 and 8 are side views of the first conditioning section 128 in the left lateral flow configuration and the right lateral flow configuration, respectively. In general, the first conditioning section 128 may include an inlet 132 to receive the air flow 114 and an outlet to direct the air flow 114 out of the first conditioning section 128 and along the air flow path 110. Moreover, as should be appreciated, the housing 108 may generally enclose the air flow path 110 of the air flow 114 on sides other than the inlet 132 and outlet 134. For example, the housing 108 may include a back wall 136, a front wall 138 (e.g., opposite the back wall 136), a longitudinal wall 140, and an opposite longitudinal wall 142 (e.g., opposite the longitudinal wall 140). As should be appreciated, in some embodiments, the back wall 136 and/or the front wall 138 may be removeable, such as to access the heat exchanger 112. Furthermore, while discussed herein as walls, as should be appreciated, the walls of the housing 108 may be considered as any enclosing or dividing feature, such as a sidewall, ceiling, floor, etc. Moreover, as should be appreciated, ceiling and floor may be relative to the orientation.

As discussed above, the housing 108 may be inverted in the right lateral flow configuration relative to the left lateral flow configuration. For example, the longitudinal wall 140 of the housing 108 may be disposed on the bottom (e.g., relative to vertical axis 104) in the left lateral flow configuration and be on the top in the right lateral flow configuration. As discussed above, the multi-configuration drain pan assembly 122 may utilize gravity to collect condensate dropped from the heat exchanger 112 or portion of the housing 108. However, while the housing 108 may be inverted between the different lateral flow configurations, the longitudinal drain pan 124 may not be inverted with respect to the vertical axis 104, but rather be maintained at the bottom (e.g., relative to the vertical axis 104) of the first conditioning section 128. In other words, the longitudinal drain pan 124 may be disposed on the longitudinal wall 140 in the left lateral flow configuration and disposed on the opposite longitudinal wall 142 in the right lateral flow configuration to have the same orientation, relative to the vertical axis 104 and lateral axis 102 in both configurations.

Conversely, instead of maintaining the same orientation and position, like the longitudinal drain pan 124, the perpendicular drain pan 126 may be repositioned, relative to the longitudinal drain pan 124, to be proximate the inlet 132 in either lateral flow configuration. For example, in some embodiments, the perpendicular drain pan 126 may be inverted, relative to the lateral axis 102 and/or vertical axis 104 to maintain a relationship (e.g., relative position, relative orientation, or both) with the heat exchanger 112. Moreover, in some embodiments, the heat exchanger 112 may be disposed in the same orientation, relative to the air flow 114 in either lateral flow configuration. For example, an apex 144 of the heat exchanger 112, such as the apex 144 of an evaporator, may be disposed downstream, relative to the air flow 114, of a mouth 146 of the heat exchanger 112. In some embodiments, disposing the apex 144 downstream of the mouth 146, may reduce blowoff by limiting the surface area of the heat exchanger 112 at the downstream end of the heat exchanger 112. Furthermore, the perpendicular drain pan 126 may be disposed at the mouth 146 of the heat exchanger 112 in either of the lateral flow configurations. Additionally, in some embodiments, the orientation of the perpendicular drain pan 126 is mirrored across a diagonal axis 148 (e.g., at an angle to the vertical axis 104 and lateral axis 102) in the left lateral flow configuration relative to the right lateral flow configuration.

To secure the perpendicular drain pan 126, the perpendicular drain pan 126 may be mechanically coupled (e.g., via one or more fasteners such as screws, clips, bolts, etc.) to the housing 108, the heat exchanger 112, and/or the longitudinal drain pan 124. For example, the perpendicular drain pan 126 may be fastened at the mouth 146 of the heat exchanger 112, the longitudinal wall 140, the opposite longitudinal wall 142, the back wall 136, and/or front wall 138 and/or slotted into grooves of the housing 108. Similarly, the longitudinal drain pan 124 may be mechanically coupled to the longitudinal wall 140, the opposite longitudinal wall 142, the back wall 136, and/or front wall 138 of the housing 108 and/or slotted into grooves of the housing 108. Alternatively, the longitudinal drain pan 124 may be disposed on top, relative to the vertical axis 104, of the longitudinal wall 140 or the opposite longitudinal wall 142, depending on configuration such that the longitudinal drain pan 124 is held in place via friction and gravity.

Additionally, the longitudinal drain pan 124 and/or the perpendicular drain pan 126 may include a drain 150 with one or more outputs (e.g., piped outputs) to direct the collected condensate away from the HVAC unit 100 (e.g., via piping). In the lateral flow configurations, the drain 150 of the longitudinal drain pan 124 may be used for outputting the condensate, and the drain 150 of the perpendicular drain pan 126 may be unused and/or plugged.

As should be appreciated, while discussed above in relation to lateral flow configurations, in some embodiments, the first conditioning section 128 may be disposed in a vertical flow orientation, with the air flow 114 flowing from down to up, relative to the vertical axis 104. Moreover, in some embodiments, the configuration of the multi-configuration drain pan assembly 122 may be the same in the vertical flow orientation of the first conditioning section 128 as one of the lateral flow configurations (e.g., the left lateral flow configuration). For example, the inlet 132 may be on the bottom (e.g., relative to the vertical axis 104) and the perpendicular drain pan 126 may collect condensate dropped (e.g., via gravity). Furthermore, in some embodiments, such as with a down to up air flow 114, the air flow 114 may assist in reducing the likelihood of condensate falling through the inlet 132 due to the force of the air flow 114. As such, the air flow 114 may assist in keeping the condensate on the heat exchanger 112 in areas above (e.g., relative to the vertical axis 104) the inlet 132, and the accumulated condensate on the heat exchanger 112 may travel down (e.g., relative to the vertical axis 104) and along the heat exchanger 112 to then drop into the perpendicular drain pan 126. As should be appreciated, in a vertical flow orientation, the drain 150 of the perpendicular drain pan 126 may direct the condensate away from the HVAC unit 100, and the drain 150 of the longitudinal drain pan 124 may be unused and/or plugged. For illustration purposes, one embodiment of a vertical flow orientation may be envisioned by rotating the first conditioning section 128 of FIG. 7 by 90 degrees, such that the lateral axis 102 becomes the vertical axis 104.

In some embodiments, the front wall 138 (e.g., access panel) of the housing 108 may have one or more drain opening 152 for either the drain 150 of the longitudinal drain pan 124, the drain 150 of the perpendicular drain pan 126, or both. Furthermore, as the position of the drain 150 of the perpendicular drain pan 126 changes, relative to the front wall 138, depending on the lateral flow configuration, in some embodiments, a mirrored drain opening 154 may be disposed on the front wall 138 to allow access to the drain 150 of the perpendicular drain pan 126 in the right lateral flow configuration. For example, the mirrored drain opening 154 may be approximately mirrored about the diagonal axis 148 from the drain opening 152 for the drain 150 of the perpendicular drain pan 126 in the left lateral flow configuration, as in FIG. 8. As such, the right lateral flow configuration may also be utilized in the vertical flow orientation. Alternatively, the front wall 138 may occlude the drain of the perpendicular drain pan 126 in one of the lateral flow configurations, such as in FIG. 7. Moreover, in some embodiments, one or more of the drain opening 152 may be occluded with an insert 156 when the corresponding drain 150 is unused.

Furthermore, as should be appreciated, while discussed herein as having an inlet and an outlet, there may or may not be physical distinction (e.g., wall) delineating the first conditioning section 128 from other portions (e.g., the second conditioning section 130) of the HVAC unit 100. Moreover, while illustrated in FIGS. 5 and 6 as having the first conditioning section 128 prior to (relative to the air flow path 110 of the air flow 114) the second conditioning section 130, the relative positions with respect to the air flow path 110 may be different depending on implementation. Furthermore, while illustrated in FIGS. 5 and 6 as including a first conditioning section 128 and a second conditioning section 130, the multi-configuration drain pan assembly 122 may be utilized with any suitable HVAC unit 100 or portion thereof having a first conditioning section with a housing 108 that is disposed in different orientations (relative to the lateral axis 102 and/or vertical axis 104) for different lateral flow configurations.

Figure 9:
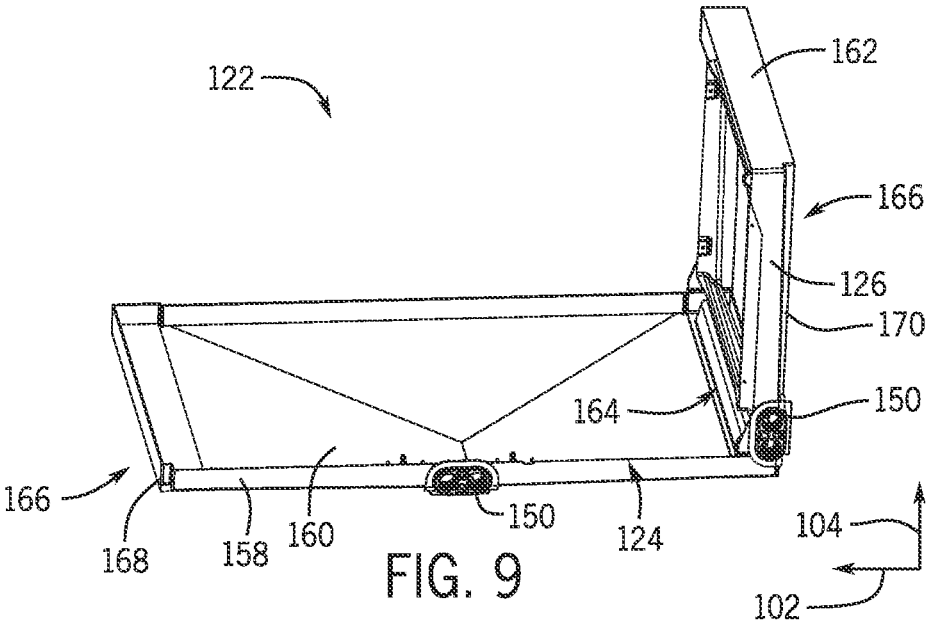
FIG. 9 is a perspective view a multi-configuration drain pan assembly in a left lateral flow configuration, in accordance with an aspect of the present disclosure.
Figure 10:
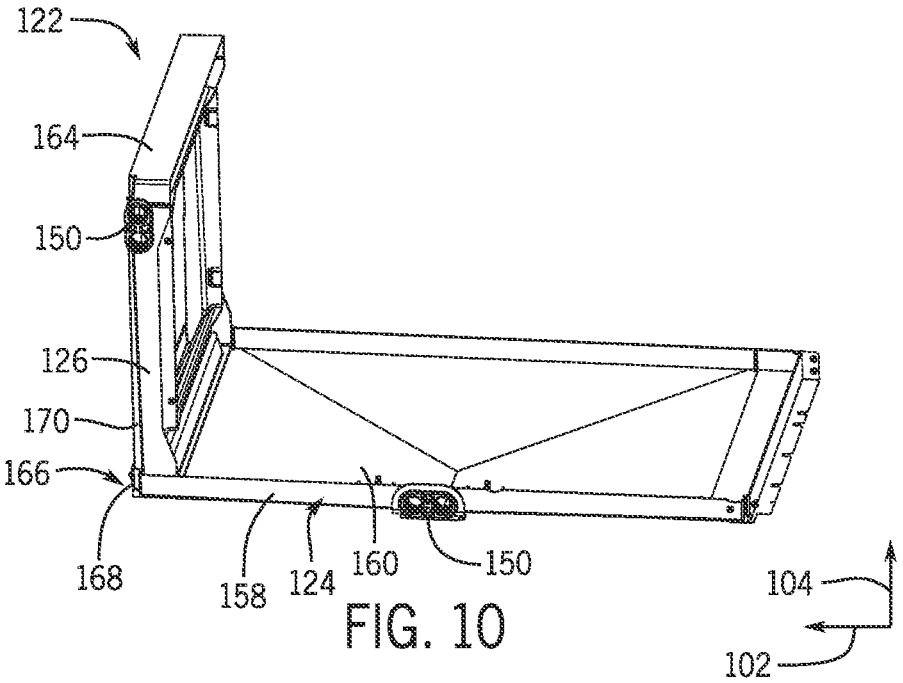
FIG. 10 is a perspective view a multi-configuration drain pan assembly in a right lateral flow configuration, in accordance with an aspect of the present disclosure.

To help further illustrate, FIGS. 9 and 10 are perspective views of the multi-configuration drain pan assembly 122 in the left lateral flow configuration and the right lateral flow configuration, respectively. As discussed above, the perpendicular drain pan 126 may be flipped (e.g., inverted) with respect to the vertical axis 104 (e.g., rotated about the transverse axis 106) and translated along the lateral axis 102 to the opposite side of the longitudinal drain pan 124 to distinguish between the lateral flow configurations. Furthermore, in some embodiments, the perpendicular drain pan 126 may fit within a sidewall 158 of the longitudinal drain pan 124 and against and/or proximate a base 160 of the longitudinal drain pan 124. Furthermore, as the perpendicular drain pan 126 is flipped with respect to the vertical axis 104 in the different lateral flow configurations, a first side 162 of the perpendicular drain pan 126 may be disposed at the opposite longitudinal wall 142 of the housing 108 in the left lateral flow configuration and in the right lateral flow configuration. Similarly, a second side 164 of the perpendicular drain pan 126 may be disposed at the longitudinal wall 140 of the housing 108 in the left lateral flow configuration and the right lateral flow configuration. As should be appreciated, as used herein, a portion (e.g., side) of a drain pan disposed "at" a wall of the housing 108 or portion of the other drain pan is meant to mean that the side of the drain pan is proximate the wall of the housing 108 or portion of the other drain pan relative to the overall orientation of the drain pans and the walls of the housing 108 and may or may not include contact therebetween.

Additionally, in some embodiments, the longitudinal drain pan 124 and/or the perpendicular drain pan 126 may include one or more mating features 166, such as grooves, indents, notches, or other interfaces that allow pairing between the longitudinal drain pan 124 and the perpendicular drain pan 126 in an orientation. For example, the longitudinal drain pan 124 perpendicular drain pan 126 may include a notch 168 at one end to interface with a groove 170 on the perpendicular drain pan 126 in one of the lateral flow orientations that would not mate if the perpendicular drain pan 126 were inverted (e.g., attempted to be installed in a misoriented fashion). Moreover, such mating features 166 may be performed for the left and right lateral flow configurations or a single lateral flow configuration.

With the foregoing in mind, the condensate collection system 120 may utilize a multi-configuration drain pan assembly 122 to improve and/or maintain condensate collection effectiveness in multiple different configurations. Furthermore, in some embodiments, the condensate collection system may utilize additional components to reduce blow off. For example, the apex 144 of the heat exchanger 112 may include a condensate receptacle that captures condensate pushed, at least in part, by the air flow 114 along the heat exchanger 112 (e.g., in a direction of the lateral axis 102) and to the apex 144. The condensate receptacle may then drain into the multi-configuration drain pan assembly 122. In addition to efficiently capturing condensate generated during operation of the HVAC unit 100, a condensate receptacle may also improve overall heat exchange efficiency of the HVAC unit 100 by blocking portions of the air flow 114 from exiting the heat exchanger 112 through the apex 144 and diverting (e.g., redirecting) the portions of the air flow 114 to flow across other portions of the heat exchanger 112, such as a heat exchange slab including heat exchange tubes and/or fins. Indeed, fins extending from and between heat exchange tubes may increase the heat transfer surface area of the heat exchange slabs, and thus increase the amount of total heat transfer of the heat exchanger 112.

As discussed above, the heat exchanger 112 may be any suitable heat exchanger 112 for conditioning the air flow 114 in the first conditioning section 128. In some embodiments the heat exchanger 112 may include microchannel tubes that extend along multiple heat exchange sections (e.g., slabs) that are fluidly coupled to one another at the apex 144. Such microchannel tubes may extend from a first heat exchange portion to a second heat exchange portion and may be bent or curved at the apex 144. In such an embodiment, the heat exchanger 112 may or may not include fins extending between the heat exchange tubes (e.g., microchannel tubes) at the apex 144 to facilitate bending of the heat exchange tubes extending from one heat exchange slab to another heat exchange slab.

Figure 11:
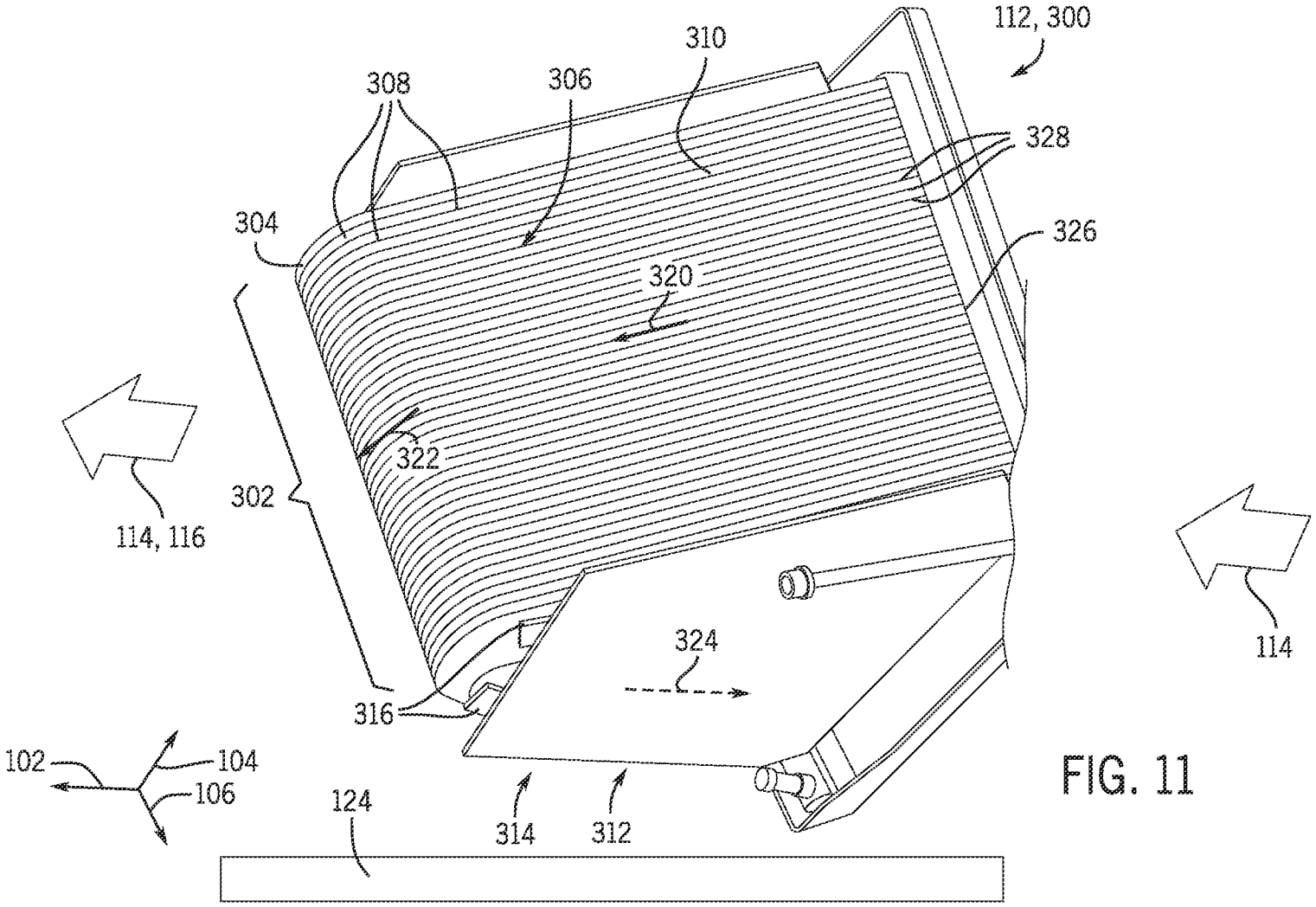
FIG. 11 is a perspective view of a micro channel heat exchanger, in accordance with an aspect of the present disclosure.

FIG. 11 is a perspective view of an example heat exchanger 112 (e.g., a microchannel heat exchanger 300) with a schematic representation of the longitudinal drain pan 124 disposed thereunder, which may be disposed within the housing 108 of the HVAC unit 100. In some embodiments, the heat exchanger 112 may be a microchannel heat exchanger 300 having multiple microchannel tubes 308 defining an "A" configuration. That is, the microchannel heat exchanger 300 includes a first section 306 and a second section 312 arranged to define the "A" configuration. Each microchannel tube 308 is included in both the first section 306 and the second section 312. For example, each microchannel tube 308 may include a first portion 310 included in the first section 306 of the microchannel heat exchanger 300 and a second portion 314 included in the second section 312 of the microchannel heat exchanger 300. The first portion 310 and the second portion 314 of each microchannel tube 308 may be fluidly coupled to one another via a bent portion 302 of the respective microchannel tube 308. Thus, the first portion 310 and the second portion 314 of the microchannel heat exchanger 300 are fluidly coupled to one another.

The bent portions 302 of the microchannel tubes 308 may define an apex 304 of the microchannel heat exchanger 300. To facilitate manufacturing of the microchannel heat exchanger 300, the bent portions 302 of the microchannel tubes 308 may not include fins extending therebetween. Specifically, the microchannel tubes 308 may be bent at the bent portions 302 and may be angled, twisted, or otherwise manipulated to enable desired packaging or arrangement of the microchannel tubes 308 relative to one another in the "A" configuration without compromising (e.g., blocking, restricting) internal flow paths (e.g., microchannels) of the microchannel tubes 308. As a result, the microchannel tubes 308 may not include fins extending therebetween at the bent portions 302 (e.g., the apex 304). However, the first section 306 of the microchannel heat exchanger 300 may include fins extending between the first portions 310 of the microchannel tubes 308, and the second section 312 of the microchannel heat exchanger 300 may include fins extending between the second portions 314 of the microchannel tubes 308.

As similarly discussed above, the first and second sections 306, 312 of the microchannel heat exchanger 300 may be disposed at an angle relative to one another and the air flow 114 through the housing 108 and across the microchannel heat exchanger 300. The first portions 310 of the microchannel tubes 308 in the first section 306 may extend along the lateral axis 102 at a downward slope or angle relative to the vertical axis 104, and the second portions 314 of the microchannel tubes 308 in the second section 312 may extend along the lateral axis 102 at an upward slope or angle relative to the vertical axis 104. Thus, the first and second sections 306, 312 of the microchannel heat exchanger 300 converge towards one another in the direction of the air flow 114 along the lateral axis 102, such that respective downstream ends 316 (e.g., relative to the air flow 114) of the first and second sections 306, 312 of the microchannel heat exchanger 300 may partially define the apex 304 (e.g., a vertex of the "A" configuration) of the microchannel heat exchanger 300.

As mentioned above, each microchannel tube 308 may include multiple channels or flow paths (e.g., internal flow paths, microchannels) formed therethrough to direct a flow of refrigerant through the microchannel tubes 308 (e.g., through the first portion 310, the bent portion 302, and the second portion 314). During operation, the refrigerant may flow into the first portions 310 of the microchannel tubes 308, and may be directed generally in a first direction of flow 320 through the first section 306 of the microchannel heat exchanger 300 toward the apex 304 of the microchannel heat exchanger 300. The refrigerant may then flow generally in a second direction of flow 322 through the bent portions 302 of the microchannel tubes 308 that curves around the apex 304 of the microchannel heat exchanger 300. Thereafter, the refrigerant may flow into the second portions 314 of the microchannel tubes 308, and may be directed generally in a third direction of flow 324 through the second section 312 of the microchannel heat exchanger 300. Thereafter, the refrigerant may be discharged from the microchannel heat exchanger 300. It should be appreciated that, in some embodiments, the refrigerant may be directed to flow through the microchannel tubes 308 in an direction opposite that described above. For example, the refrigerant may flow into the second portions 314 of the microchannel tubes 308, flow along the second section 312 toward the bent portions 302 the microchannel tubes 308, flow around the apex 304 of the microchannel heat exchanger 300, and then flow through the first portions 310 of the microchannel tubes 308 and along the first section 306 before discharged from the microchannel heat exchanger 300.

In the illustrated embodiment, each microchannel tube 308 may have a generally ribbon shape (e.g., a width of the microchannel tube 308 is greater than a thickness or height of the microchannel tube 308), and each microchannel tube 308 may be positioned within the first and second sections 306, 312 of the microchannel heat exchanger 300 such that a width of each microchannel tube 308 extends along the vertical axis 104. Additionally, each microchannel tube 308 may extend continuously from an upstream end 326 of the first section 306 of the microchannel heat exchanger 300, around the apex 304, and to an upstream end 326 of the second section 312 of the microchannel heat exchanger 300. To this end, a portion of each microchannel tube 308 at the bent portion 302 that is bent around the apex 304 may be additionally rotated (e.g., twisted) so as to prevent crimping (e.g., closing) one or more of the fluid channels within the bent portions 302 of the microchannel tubes 308 at the apex 304. Furthermore, as mentioned above, each the first and second sections 306, 312 of the microchannel heat exchanger 300 may include a respective sets of fins 328 extending from and between the microchannel tubes 308 to increase heat transfer efficiency of the microchannel heat exchanger 300. The fins 328, 330 may additionally support and/or provide structural reinforcement to the microchannel tubes 308. However, the bent portions 302 of the microchannel tubes 308 may be fin-less or bare so as to facilitate the rotation and bending of the bent portions 302 of the microchannel tubes 308 around the apex 304 of the microchannel heat exchanger 300.

As set forth above, embodiments of the present disclosure may provide one or more technical effects useful for efficiently capturing and/or collecting condensate that forms and/or accumulates on a heat exchanger and is dislodged from the heat exchanger by gravity and/or an air flow directed across the heat exchanger (e.g., in a generally horizontal direction). In particular, a condensate collection system may include a multi-configuration drain pan assembly that allows for effective condensate collection across multiple HVAC unit orientations/configurations and reuse of the same set of drain pans (e.g., the longitudinal drain pan and the perpendicular drain pan) for the multiple HVAC unit orientations/configurations. It should be understood that the technical effects and technical problems in the specification are examples and are not limiting. Indeed, it should be noted that the embodiments described in the specification may have other technical effects and can solve other technical problems.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure.

Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112 (f). However, for any claims containing elements designated in any other manner, it is intended that such elements are not to be interpreted under 35 U.S.C. 112(f).

The invention claimed is:

1. A heating, ventilation, and air conditioning (HVAC) system, comprising:

a housing;

a heat exchanger disposed within a section of the housing and configured to condition an air flow through the housing, the section comprising an inlet configured to receive the air flow and an outlet configured to output the air flow; and a multi-configuration drain pan assembly configured to collect condensate formed by conditioning of the air flow by the heat exchanger, wherein the multi-configuration drain pan assembly comprises:

a first drain pan configured to selectively couple to the housing in one of a first set of positions within the housing, the first set of positions comprising a first position and a second position, wherein, in the first position, the first drain pan is disposed along a first wall of the housing such that a first side of the first drain pan is disposed at the inlet and a second side of the first drain pan is disposed at the outlet, and wherein, in the second position, the first drain pan is disposed along a second wall of the housing, opposite the first wall, such that the first side of the first drain pan is disposed at the outlet and the second side of the first drain pan is disposed at the inlet; and a second drain pan configured to selectively couple to the housing in one of a second set of positions within the housing, the second set of positions comprising a third position and a fourth position, wherein, in the third position the second drain pan is disposed about the inlet such that a third side of the second drain pan is disposed at the first side of the first drain pan, and wherein in the fourth position the second drain pan is disposed about the inlet such that a fourth side of the second drain pan, opposite the third side, is disposed at the second side of the first drain pan.

2. The HVAC system of claim 1, wherein in the third position and the fourth position, the third side of the second drain pan is disposed at the first wall of the housing and the fourth side of the second drain pan is disposed at the second wall of the housing.

3. The HVAC system of claim 2, wherein a first configuration of the multi-configuration drain pan assembly comprises the first drain pan in the first position and the second drain pan in the third position.

4. The HVAC system of claim 3, wherein a second configuration of the multi-configuration drain pan assembly comprises the first drain pan in the second position and the second drain pan in the fourth position.

5. The HVAC system of claim 1, wherein the housing comprises a third wall comprising a drain opening configured to provide access to a drain of the second drain pan, in response to the first drain pan being in the first position and configured to be occluded, via an insert, in response to the first drain pan being in the second position.

6. The HVAC system of claim 5, wherein the third wall comprises a second drain opening configured to provide access to the drain in response to the first drain pan being in the second position and configured to be occluded, via the insert, in response to the first drain pan being in the first position, and wherein the drain opening and the second drain opening are disposed on the third wall at mirrored positions about a diagonal axis from the inlet to the outlet.

7. The HVAC system of claim 5, wherein the third wall is configured to occlude the drain in response to the first drain pan being in the second position.

8. The HVAC system of claim 7, wherein the housing comprises an access opening configured to provide access into an interior of the housing, wherein the third wall of the housing comprises an access panel configured to operatively occlude the access opening.

9. The HVAC system of claim 1, wherein the heat exchanger comprises an evaporator coil of a refrigerant circuit.

10. The HVAC system of claim 9, wherein the evaporator coil comprises an apex oriented away from the inlet.

11. A multi-configuration drain pan assembly comprising:

a first drain pan comprising a first side, a second side opposite the first side, and a first drain and configured to, in response to the first drain pan being oriented laterally, relative to gravity, in one of a set of lateral configurations, receive condensate dripped onto the first drain pan and output the condensate via the first drain, wherein the set of lateral configurations comprises a first lateral configuration and a second lateral configuration; and a second drain pan, perpendicular to the first drain pan, comprising a third side, a fourth side opposite the third side, and a second drain and configured to, in response to the first drain pan being oriented vertically, relative to gravity, in a vertical configuration, receive the condensate dripped onto the second drain pan and output the condensate via the second drain, wherein the second drain pan is configured to be disposed at the first side of the first drain pan in the first lateral configuration and disposed at the second side of the first drain pan in the second lateral configuration.

12. The multi-configuration drain pan assembly of claim 11, wherein the third side of the second drain pan is configured to be disposed at the first side of the first drain pan in the first lateral configuration, and wherein the fourth side of the second drain pan is configured to be disposed at the second side of the first drain pan in the second lateral configuration.

13. The multi-configuration drain pan assembly of claim 11, wherein the first side of the first drain pan comprises a sidewall, wherein the second drain pan is configured to be retained within the sidewall of the first drain pan in the first lateral configuration.

14. The multi-configuration drain pan assembly of claim 13, wherein the sidewall comprises a protruding notch, and wherein the second drain pan comprises a groove configured to receive the protruding notch in the first lateral configuration.

15. A heating, ventilation, and air conditioning (HVAC) system comprising:

a housing comprising a first wall and a second wall opposite the first wall;

an evaporator disposed within a portion of the housing and configured to cool an air flow, wherein the portion comprises an inlet configured to receive the air flow and an outlet configured to output the air flow, and wherein the first wall and the second wall each extend from the inlet to the outlet; and a multi-configuration drain pan assembly configured to collect condensate formed by cooling of the air flow by the evaporator, wherein the multi-configuration drain pan assembly comprises:

a first drain pan configured to selectively couple to the housing in one of a first set of positions within the housing, the first set of positions comprising a first position and a second position, wherein, in the first position, the first drain pan is disposed along the first wall such that a first side of the first drain pan is disposed at the inlet and a second side of the first drain pan is disposed at the outlet, and wherein, in the second position, the first drain pan is disposed along the second wall, such that the first side of the first drain pan is disposed at the outlet and the second side of the first drain pan is disposed at the inlet; and a second drain pan configured to be coupled to the housing about the inlet, the second drain pan comprising a third side disposed at the first wall of the housing and a fourth side disposed at the second wall of the housing.

16. The HVAC system of claim 15, wherein the first drain pan is configured to selectively couple to the housing in the first position when the housing is in a first orientation relative to a cartesian plane and selectively couple to the housing in the second position when the housing is in a second orientation inverted with respect to the cartesian plane relative to the first orientation.

17. The HVAC system of claim 16, wherein the second drain pan is configured to selectively couple to the housing in one of a second set of positions within the housing, the second set of positions comprising a third position and a fourth position, wherein, in the third position the second drain pan is disposed about the inlet such that the third side of the second drain pan is disposed at the first side of the first drain pan, and wherein in the fourth position the second drain pan is disposed about the inlet such that the fourth side of the second drain pan, opposite the third side, is disposed at the second side of the first drain pan.

18. The HVAC system of claim 17, wherein the second drain pan is configured to selectively couple to the housing in the third position when the housing is in the first orientation and selectively couple to the housing in the third position when the housing is in the second orientation.

19. The HVAC system of claim 16, wherein a first direction of flow of the air flow in the first orientation is opposite, relative to the first drain pan, a second direction of flow of the air flow in the second orientation.

20. The HVAC system of claim 16, wherein the first drain pan is configured to selectively couple to the housing in the first position when the housing is in a third orientation, perpendicular to the first orientation and the second orientation.

* * * * *